United States Patent [19]

Potter

[11] Patent Number: 4,588,236

[45] Date of Patent: May 13, 1986

[54] ROTARY FILE CABINET

[76] Inventor: Frank Potter, 270 Adams Blvd., Farmingdale, N.Y. 11735

[21] Appl. No.: 585,391

[22] Filed: Mar. 2, 1984

[51] Int. Cl.[4] ..... A47B 49/00

[52] U.S. Cl. ..... 312/201; 312/271; 312/275

[58] Field of Search ..... 312/202, 271, 252, 275, 312/324, 326

[56] References Cited

U.S. PATENT DOCUMENTS

| | | | |
|---|---|---|---|
| 409,009 | 8/1889 | Buckmaster | 312/324 |
| 1,023,385 | 4/1912 | Medio | 312/324 |
| 2,347,270 | 4/1944 | Larsson | 312/271 |
| 2,598,814 | 6/1952 | McAfee | 312/275 |
| 3,510,186 | 5/1970 | Diebel et al. | 312/271 |
| 3,868,157 | 2/1975 | Robinson | 312/286 |

*Primary Examiner*—William E. Lyddane
*Assistant Examiner*—Joseph Falk
*Attorney, Agent, or Firm*—Nicholas J. Garofalo

[57] ABSTRACT

A rotary file cabinet having two opposed open sides and two opposed walled sides mounted upon a rotatable base for selective rotation to present either its open or walled sides to face the user; the cabinet being of quadrate form adapted to be aligned in a row with similar cabinets and in spaced relation to each other so as to enable free unobstructed rotation of one relative to the other; the cabinet having a door hinged to each vertical side of each side wall thereof adapted in a closed condition to cover over one-half of the spacing between the cabinet and its neighbors so as to present with a similar condition of the neighboring cabinets a continuous wall appearance; and the cabinet including spring loaded lever means connecting diagonally opposed doors of the cabinet with each other, the lever means adapted upon an initial manual turning of a selected door to effect a corresponding turning of the opposed door and adapted upon the doors being turned approximately 90 degrees to react and cause both opposed doors to become fully turned to either an opened or closed condition, the doors being restrained by the spring load in either condition against loose movement; and the cabinet being adapted in a fully opened condition of its doors to be rotated freely relative to neighboring cabinets.

2 Claims, 2 Drawing Figures

ROTARY FILE CABINET

BACKGROUND OF THE INVENTION

This invention is directed, in general, to rotary file cabinets of a type having a pair of opposed walled sides and a pair of opposed open sides.

In use, such cabinets are designed to be closely arranged in a row intermediately of a room, so as to present the appearance of a partition wall having at opposite sides thereof a continuous wall appearance when all of the walled sides of the cabinets face the room. This arrangement also enables a user standing at either side of the room to rotate any selected cabinet in the row in either direction so as to present either of its open or walled sides to face him. A cabinet is considered to be open when its open sides face the room; and it is considered to be closed when its walled sides face the room.

Such cabinets are of quadrate form and, when arranged in a row, a space must necessarily be provided between neighboring cabinets to enable unobstructed rotary movement of one cabinet relative to the other. This is so primarily because of the various corners of the cabinets. It is accordingly required that the spaces be concealed in some suitable manner in order to obtain the intended and greatly desired continuous wall appearance in the closed condition of the cabinets.

An attempt to solve this spacing problem has been made with known rotary file cabinets by housing them in an outer stationary overall cabinet provided with vertical panels arranged to front the spacing. In this manner some degree of a continuous wall appearance is obtained in the closed condition of the several file cabinets. A particular disadvantage of this arrangement is the cost of the outer cabinet and the labor required to assemble the individual cabinets in the outer cabinet or to disassemble them for purposes of repair, transport or repositioning.

A general object of the present invention is to provide a rotary file cabinet which avoids the faults and consequent disadvantages associated with known rotary file cabinets.

A further object of the invention is to provide a rotary file cabinet having a pair of opposed wall sides and a pair of open sides, and which can be arranged in a row with other cabinets so as to present in a closed condition the appearance of a continuous wall without the necessity of an outer overall cabinet or housing.

A more particular object of the invention is to provide a rotary file cabinet with doors adjacent its wall sides, which doors can be closed so as to extend or cover over approximately one-half of the spaces separating it from neighboring cabinets in a row of file cabinets, the other half of the spaces being coverable by the doors of the neighboring cabinets. When the doors are closed, the desired continuous wall appearance is obtained.

Another object of the invention is to provide manually operable mechanism for opening and closing the doors of a rotary file cabinet, whereby the doors at both sides of the cabinet may be actuated to an open or closed condition by a user located at at either side of the cabinet. In the open condition of the doors the cabinet can be rotated without any part thereof striking a neighboring cabinet.

And a further, though not the last of the objects of the invention is to provide manually operable door opening and closing mechanism for a rotary file cabinet which functions upon opening or closing the doors to restrain them in such condition against wobble or loose movement.

SUMMARY OF THE INVENTION

In accordance with the invention there is provided a file cabinet mounted upon a rotatable base, such as that described in my copending patent application, Ser. No. 534,271, filed Sept. 21, 1983.

The cabinet has a pair of opposed wall sides. and a pair of opposed open sides providing access to its interior. Each wall side has a narrow door hinged to each of its vertical sides. Each door, when closed, is continuous and coplanar with the adjacent wall and extends laterally for a short distance beyond the cabinet. When fully opened, each door lies flat upon the outer face of the adjacent wall. A pair of spring loaded lever mechanisms associated with the doors of the cabinet are manually operable to effect the simultaneous opening or closing of the doors at opposite sides of the cabinet by a user standing at either side of the cabinet. The mechanism functions upon opening or closing the doors to restrain them in such condition against wobble or loose movement.

When the cabinet is arranged in a row with similar cabinets and its doors and the doors of the neighboring cabinets are in a closed condition to simulate a continuous partition wall, the spacing between the cabinets normally required for the unobstructed turning of one cabinet relative to its neighbor is closed over by the laterally extended postions of the doors of the neighboring cabinets. Each door portion is predetermined in its lateral dimension so as to cover over approximately one-half of the space. In the fully opened condition of the doors the cabinet can be rotated as desired in either direction without striking a neighboring cabinet.

A desirable cost and labor saving advantage of the cabinet structure of the present invention is that an outer cabinet or housing, as exists in known structures, is not required to cover over the spaces separating the cabinets in a row.

Another favorable advantage of the cabinet of the invention is that it may be readily assembled with others in a row or disassembled therefrom. The time consuming labor and cost required for housing them in an outer cabinet, as is needed with known rotary file cabinets, is eliminated.

A desirable advantage is also provided by the door actuating mechanism in that it enables opening or closing of the doors at opposite sides of the cabinet by a user standing at one or the other side of the cabinet.

A still further advantage is provided by the springs associated with the door actuating mechanism. These cause the doors to be spring loaded in the closed or open position, thus avoiding undesirable loose movement or flopping of the doors during rotation of the cabinet from one position to another.

The foregoing structure, features and advantages of the invention will become increasingly apparent as this specification unfolds in greater detail, and as it is read in conjunction with the accompanying drawing wherein an embodiment of the invention is shown. However, it is to be expressly understood that the drawing is for purposes of illustration; and it is not to be construed as limiting the scope of the invention.

DESCRIPTION OF PREFERRED EMBODIMENT

Figure 2:
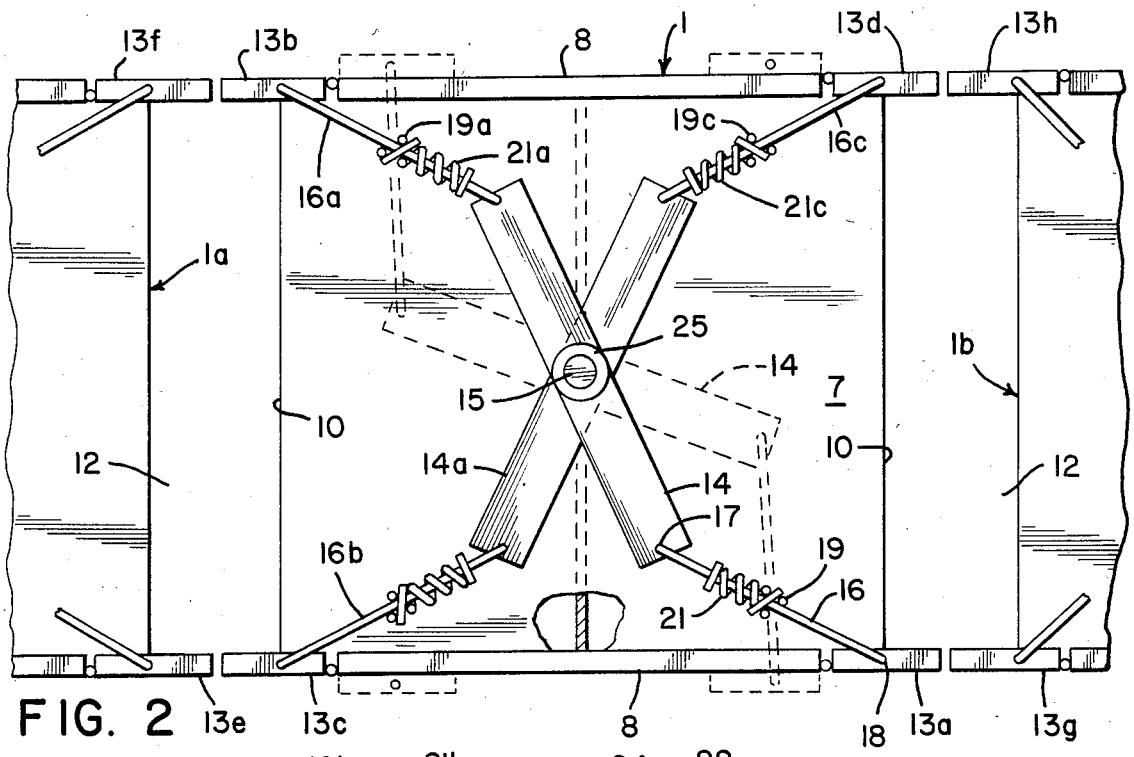
FIG. 2 is a top plan view of FIG. 1.

The invention will now be described with reference to the accompanying drawing sufficiently and in such concise manner as to enable persons having ordinary skill in the art to understand and use the invention.

The drawing discloses a file cabinet 1 mounted upon a base 2. The base, detailed in my copending earlier mentioned patent application, includes a stationary lower floor member 3 and a rotatable upper member 4. The latter rests upon a ring of ball bearing rollers supported on the floor member and has a pivot shaft 6 depending axially from its underside through a pivot hole formed axially of the floor member, whereby the upper member 4 is selectively rotatable over the ball bearing rollers in either direction through 360 degrees relative to the lower member 3.

The file cabinet 1 includes a right-angled four-sided quadrate top panel 7, to each of two opposed side edges of which is fixed a depending side wall 8. The lower ends 9 of the side walls are fixed to the rotatable upper member 4 of the base. The area between the side walls defines a pair of opposed open sides 10 providing access to the interior of the cabinet. A partition panel 11 may be provided intermediately of the cabinet to define a pair of opposed open compartments 10*a*, each of which may be provided with suitable shelving or other means for storage of documents, files or other items.

The cabinet is particularly suited for use in numbers of two or more, aligned in a row to simulate a partition wall of a room. In such an arrangement the individual cabinets may be used by persons at opposite sides thereof, each of whom may rotate any selected cabinet to bring an open or closed side thereof before him.

Figure 1:
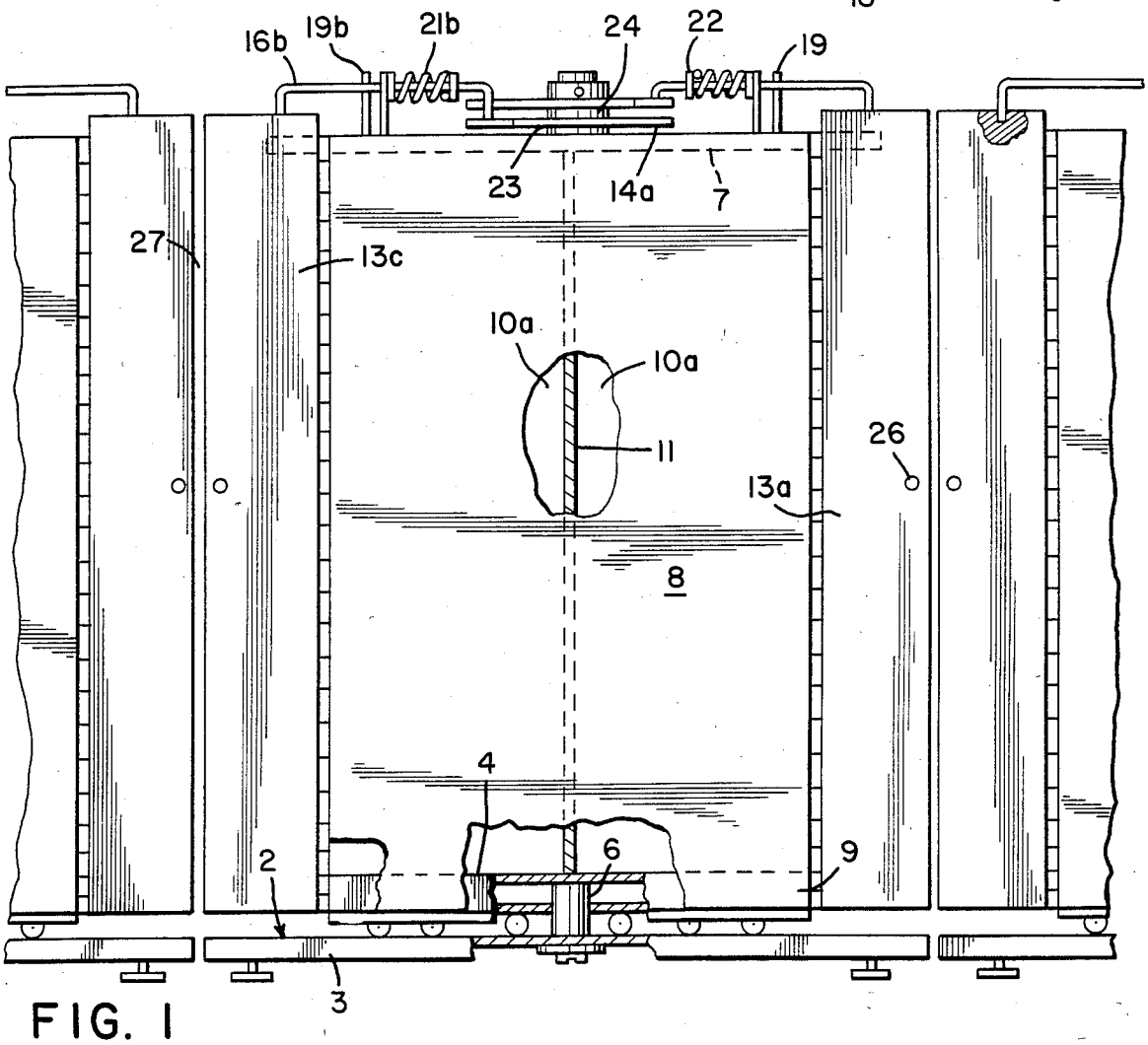
FIG. 1 is a side elevation view showing the cabinet in its closed condition with portions cut away exposing the base, and also showing the association of the cabinet in a row with neighboring cabinets which are also shown in a closed condition.

When the cabinets are arranged in a row, as in FIGS. 1 and 2, a space 12 is required between neighboring cabinets, sufficient to enable a cabinet to be rotated freely without any part thereof, such as its corners, striking a neighboring cabinet. When the side walls of cabinets aligned in a row face the room or viewer, these spaces would, unless covered over, break up the intended and much desired continuous wall appearance.

As earlier mentioned, an object of the invention is to provide a rotary file cabinet that can be arranged with other cabinets in a row with the needed spacing between and still effect a desirable concealment of the spacing to obtain a continuous wall appearance when the several cabinets are in their closed condition with their wall sides facing the room. To accomplish this object, each side wall 8 of the cabinet has a lateral dimension that is shorter than the related side edge of the top panel 7. Hinged to each vertical side edge of each side wall is a narrow vertical door. There are four such doors to a cabinet, and they are identified by the numerals 13*a, b, c,* and *d*. In its closed condition, as in FIGS. 1 and 2, each door extends laterally beyond the related side edge of the top panel and the related open side 10 of the cabinet sufficiently to cover over approximately one-half of a space 12. Corresponding doors 13*e, f, g* and *h* of the neighboring cabinets 1*a* and 1*b* similarly extend to cover over the other halves of the spaces. In their closed condition the doors at each side of the cabinet 1 are coplanar with the related side wall and, together with a similar condition of the neighboring cabinets 1*a* and 1*b*, present the appearance of a continuous flat wall surface, as in FIG. 1.

In order to enable a free unobstructed rotation of any cabinet in a row relative to neighboring cabinets, it is required before rotating the cabinet that its doors be drawn clear of the spaces 12. Suitable manually operable door actuating mechanism is provided for this purpose, whereby the doors at both sides of the cabinet may be drawn clear of the spaces, or closed to cover them by a person standing at either side of the cabinet.

The door actuating mechanism for each cabinet includes a flat bar lever 14 centered for pivotal movement about a stub shaft or pivot 15. The latter is fixed to and projects upward from the center of the top panel 7. The lever is pivotally connected by an actuating rod 16 with the door 13*a*. In this respect, the rod has a right-angled inner end 17 depending through a pivot hole in one end of the lever; and the rod has an opposite similar end 18 depending in a pivot hole in the mid-area of the top end of door 13*a*. Between the lever and the door the rod extends through a guide 19 mounted atop the top panel 7. Here, the guide comprises a pair of posts defining between them an opening through which the rod is slidable; and it serves not only as a guide but also as a fulcrum to the movements of the rod. A coil spring 21 sleeving the rod presses at one end against a shoulder 22 on the rod, and limits at its opposite end against a washer abutting the guide. The opposite end of the lever is similarly associated by a rod 16*a*, a guide 19*a* and a spring 21*a* with a second door 13*b* located diagonally opposite to door 13*a*. A second lever 14*a* is similarly associated by rods 16*b* and *c*, guides 19*b* and *c*, and springs 21*b* and *c* with the diagonally opposed doors 13*c* and *d*.

The levers 14 and 14*a* cross each other in the manner of an X. The lower lever 14*a* rests upon a shoulder 23 of pivot 15. A washer 24 spaces the upper lever from the lower one; and a suitable keeper 25 retains the levers on the pivot.

Cabinet 1 is shown in FIGS. 1 and 2 in a row with neighboring cabinets. Its doors are in a fully closed condition. Now, to bring an open side of the cabinet before him, the user must first bring the doors to a fully opened condition so as to ensure a free and clear subsequent turning of the cabinet relative to the neighboring cabinets. Accordingly, the user manually grips an edge or a finger hole of anyone of the doors, here for example, the finger hole 26 of door 13*a* and turns the door outwardly on its hinge. The initial outward movement of the door pulls the related rod 16 slidingly through its related guide 19 and at the same time pivots the rod about the guide. This movement of rod 16 acts through a consequent pivoting of lever 14 to effect a corresponding movement of rod 16*a* and a consequent outward movement of door 13*b*. In this initial movement of the rods the related springs 21 and 21*a* are progressively compressed. Next, when the doors 13*a* and *b* have been moved outwardly through an arc of a little more than 90 degrees, both rods obtain a pivoted position relative to their guides and the lever in which position the springs 16 and 16*a* suddendly become relaxed and expand. As they expand, they drive both rods simultaneously inward through their guides to swing the lever further about its pivot, sufficiently to bring both doors 13*a* and *b* to a fully opened condition upon the outer faces of the related side walls of the cabinet, as indicated in broken line in FIG. 2. The doors are restrained in this open condition against loose movement under the load of the springs.

Next, the user similarly manipulates the other door 13*c* at his side of the cabinet to effect a similar open condition of both doors 13*c* and *d*. Finally, the user manually rotates the cabinet through 90 degrees in one direction or the other to bring either of the open compartment sides 10 of the cabinet to face him. In this action the cabinet moves freely through the spaces 12 without its corners or any other part thereof striking the neighboring cabinets. The spring loaded open condition of the doors prevents any loose movement of the doors as the cabinet is being rotated.

To return the wall sides 8 of the cabinet to face the user or the room, the user manually rotates the cabinet 90 degrees in either direction. He then manipulates one of the doors on its hinge in a closing direction sufficiently to cause the related spring pressed rods and related lever to react and pull the manually actuated door and the diagonally opposed door to closed condition. The other door at the user's side is similarly acted upon to bring it and the diagonally opposed door to the closed condition. The doors are restrained in their closed condition against loose movement by the load of the related springs.

A slight narrow vertical crack 27 that remains between neighboring closed doors is insignificant, and does not detract from the continuous wall appearance provided by the several cabinets. A strip of soft pliable material, not shown, may if desired be provided along the edging of the doors adjacent the crack.

While an embodiment of the invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such forms and modifications or equivalents thereof as might be construed to be within the spirit of the invention, when considered in the light of the specification, the drawing and the appended claims.

What is claimed is:

1. A rotary file cabinet comprising a base having an upper member rotatable relative to a lower stationary member; and a file cabinet mounted upon the upper member for rotation with the latter, the file cabinet having a top member of quadrate form and two opposed side walls of rectangular form, one of which side walls depends vertically from one side edge of the top member and the other of which depends vertically from an opposite side edge of the top member, the side walls being fixed at their bottom ends to the upper member of the base, and the side walls defining between them a pair of opposed open sides to the file cabinet allowing access to the interior of the file cabinet; wherein each side wall is narrower in width than the related side edge of the top member; a separate door is hinged to each vertical side edge of each side wall; each door in a closed position has a condition in which it extends laterally beyond the top member and is coplanar with the related side wall; and each door in an open position has a condition in which it overlaps an outer face of the related side wall; the file cabinet being adapted to be disposed in a row with and in a predetermined spaced relation to similar neighboring cabinets, the spacing being such that the doors of the file cabinet in their closed position close over approximately one-half of the spacing and present a continuous wall appearance with neighboring cabinets having the same condition of their doors, and in the open position of the doors of the file cabinet the said spacing being such as to enable the file cabinet to be rotated clear of the neighboring cabinets so as to present its open sides to a user; wherein each door is manually turnable on its hinges from one position to the other; wherein a first lever means operatively connects a first one of the doors of one side wall of the cabinet with a diagonally located door of the other side wall of the cabinet, the first lever means comprising a pivot shaft fixed axially of the top member, a first lever centered on the pivot shaft, a lever actuating rod pivoted at one end to the lever and pivoted at its opposite end intermediately of a top end of the first one of the doors, a guide through which the rod passes and by which the rod is guided for movement, the guide having a fixed position on the top member, a second lever actuating rod similarly associating an opposite end of the lever with the diagonally located door, the first lever means being responsive to manual turning of one of the connected doors in a selected direction to effect a corresponding directional turning of the other connected door; and wherein a second similar lever means is mounted upon the pivot shaft and similarly associates a second one of the doors of one side wall of the cabinet with a diagonally located second door of the other side wall of the cabinet, and the second lever means being responsive to manual turning of one of the second doors in a selected direction to effect a corresponding directional turning of the other connected second door.

2. A rotary file cabinet as in claim 1, wherein a separate coil spring is disposed on each of the rods and is limited between the related guide and an abutment on the related rod, the springs exerting in a closed condition of the doors forces yieldably restraining the doors in their closed position and exerting in an open condition of the doors forces yieldably restraining the doors in their open position.

* * * * *